US006008831A

United States Patent [19]

Nakanishi et al.

[11] Patent Number: 6,008,831

[45] Date of Patent: Dec. 28, 1999

[54] APPARATUS FOR CONTROLLING DRIVING OF THERMAL PRINTHEAD

[75] Inventors: Masatoshi Nakanishi; Yutaka Tatsumi; Kunio Motoyama, all of Kyoto, Japan

[73] Assignee: Rohm Co., Ltd., Kyoto, Japan

[21] Appl. No.: 08/894,588

[22] PCT Filed: Feb. 21, 1996

[86] PCT No.: PCT/JP96/00397

§ 371 Date: Aug. 22, 1997

§ 102(e) Date: Aug. 22, 1997

[87] PCT Pub. No.: WO96/26073

PCT Pub. Date: Aug. 29, 1996

[30] Foreign Application Priority Data

Feb. 23, 1995 [JP] Japan ..... 7-034956

[51] Int. Cl.[6] ..... B41J 2/36

[52] U.S. Cl. ..... 347/195; 347/196

[58] Field of Search ..... 347/195, 196; 400/120.15

[56] References Cited

U.S. PATENT DOCUMENTS

| | | | |
|---|---|---|---|
| 4,567,488 | 1/1986 | Moriguichi et al. | 347/196 |
| 5,157,761 | 10/1992 | Hawkes . | |
| 5,346,318 | 9/1994 | Endo | 347/195 |
| 5,483,273 | 1/1996 | Fujimoto et al. | 347/195 |

FOREIGN PATENT DOCUMENTS

| | | |
|---|---|---|
| 58-67477 | 4/1983 | Japan . |
| 60-139465 | 7/1985 | Japan . |
| 61-116555 | 6/1986 | Japan . |
| 63-230367 | 9/1988 | Japan . |
| 2-235655 | 9/1990 | Japan . |
| 4-71864 | 3/1992 | Japan . |
| 4-305471 | 10/1992 | Japan . |

*Primary Examiner*—Huan Tran
*Attorney, Agent, or Firm*—Merchant & Gould P.C.

[57] ABSTRACT

A plurality of shift register groups 13*a*–13*d* each consisting of a plurality of registers are provided to store a next one of printing data, a current one of the printing data, a predetermined number of previous ones of the printing data and a predetermined number of previous ones of the printing data for an adjacent heating dot. A plurality of pattern discerning circuits 14*a*–14*d* are also provided to consecutively discern history patterns of respective heating dots and output corresponding driving data, so that the printing energy for a heating dot is made smaller when its next one of the printing data stored in the shift register group 13*a*–13*d* is "0" than when the next one of the printing data is "1".

6 Claims, 10 Drawing Sheets

FIG. 2

| History Pattern No. | A0 | A1 (Selected Dot) | A2 | A3 | A4 | LR | Level |
|---|---|---|---|---|---|---|---|
| 1 | 1 | 1 | 0 | 0 | 0 | 0 | 1 |
| 2 | 1 | 1 | 0 | 1 | 0 | 0 | 2 |
| 3 | 1 | 1 | 0 | 0 | 1 | 0 | 2 |
| 4 | 1 | 1 | 0 | 0 | 0 | 1 | 2 |
| 5 | 1 | 1 | 0 | 0 | 1 | 1 | 2 |
| 6 | 1 | 1 | 1 | 0 | 0 | 0 | 3 |
| 7 | 1 | 1 | 0 | 1 | 1 | 0 | 3 |
| 8 | 1 | 1 | 1 | 0 | 1 | 0 | 4 |
| 9 | 1 | 1 | 1 | 1 | 0 | 0 | 4 |
| 10 | 1 | 1 | 1 | 0 | 0 | 1 | 4 |
| 11 | 1 | 1 | 0 | 1 | 1 | 1 | 4 |
| 12 | 1 | 1 | 0 | 1 | 0 | 1 | 4 |
| 13 | 1 | 1 | 1 | 1 | 1 | 0 | 4 |
| 14 | 1 | 1 | 1 | 1 | 1 | 1 | 5 |
| 15 | 1 | 1 | 1 | 0 | 1 | 1 | 5 |
| 16 | 1 | 1 | 1 | 1 | 0 | 1 | 5 |
| 17 | 0 | 1 | 0 | 0 | 0 | 0 | 1 |
| 18 | 0 | 1 | 0 | 1 | 0 | 0 | 2 |
| 19 | 0 | 1 | 0 | 0 | 1 | 0 | 2 |
| 20 | 0 | 1 | 0 | 0 | 0 | 1 | 2 |
| 21 | 0 | 1 | 0 | 0 | 1 | 1 | 2 |
| 22 | 0 | 1 | 0 | 1 | 1 | 0 | 3 |
| 23 | 0 | 1 | 0 | 1 | 1 | 1 | 4 |
| 24 | 0 | 1 | 0 | 1 | 0 | 1 | 4 |
| 25 | 0 | 1 | 1 | 0 | 1 | 0 | 4 |
| 26 | 0 | 1 | 1 | 0 | 1 | 1 | 5 |
| 27 | 0 | 1 | 1 | 0 | 0 | 1 | 5 |
| 28 | 0 | 1 | 1 | 0 | 0 | 0 | 5 |
| 29 | 0 | 1 | 1 | 1 | 0 | 0 | 6 |
| 30 | 0 | 1 | 1 | 1 | 0 | 1 | 6 |
| 31 | 0 | 1 | 1 | 1 | 1 | 0 | 6 |
| 32 | 0 | 1 | 1 | 1 | 1 | 1 | 6 |
| 33 | 1 | 0 | 0 | 0 | 0 | 0 | 6 |

FIG. 9

| History Pattern No. | Selected Dot ↓ A1 | A2 | A3 | A4 | LR | Level |
|---|---|---|---|---|---|---|
| ① | 1 | 0 | 0 | 0 | 0 | 1 |
| ② | 1 | 0 | 1 | 0 | 0 | 2 |
| ③ | 1 | 0 | 0 | 1 | 0 | 2 |
| ④ | 1 | 0 | 0 | 0 | 1 | 2 |
| ⑤ | 1 | 0 | 0 | 1 | 1 | 2 |
| ⑥ | 1 | 1 | 0 | 0 | 0 | 3 |
| ⑦ | 1 | 0 | 1 | 1 | 0 | 3 |
| ⑧ | 1 | 1 | 0 | 1 | 0 | 4 |
| ⑨ | 1 | 1 | 1 | 0 | 0 | 4 |
| ⑩ | 1 | 1 | 0 | 0 | 1 | 4 |
| ⑪ | 1 | 0 | 1 | 1 | 1 | 4 |
| ⑫ | 1 | 0 | 1 | 0 | 1 | 4 |
| ⑬ | 1 | 1 | 1 | 1 | 0 | 4 |
| ⑭ | 1 | 1 | 1 | 1 | 1 | 5 |
| ⑮ | 1 | 1 | 0 | 1 | 1 | 5 |
| ⑯ | 1 | 1 | 1 | 0 | 1 | 5 |

FIG. 10

Selected Dot ↓

| History Pattern No. | A1 | A2 | A3 | LR | Level |
|---|---|---|---|---|---|
| ① | 1 | 0 | 0 | 0 | 1 |
| ② | 1 | 0 | 1 | 0 | 2 |
| ③ | 1 | 0 | 0 | 1 | 2 |
| ④ | 1 | 1 | 0 | 0 | 3 |
| ⑤ | 1 | 1 | 1 | 0 | 4 |
| ⑥ | 1 | 1 | 0 | 1 | 4 |
| ⑦ | 1 | 0 | 1 | 1 | 4 |
| ⑧ | 1 | 1 | 1 | 1 | 5 |

APPARATUS FOR CONTROLLING DRIVING OF THERMAL PRINTHEAD

TECHNICAL FIELD

The present invention relates to an apparatus for controlling driving of a thermal printhead, and particularly to those suitable for improving printing quality for a high-speed printing operation.

BACKGROUND ART

In thermal printheads, a plurality of heating dots are arranged linearly with a predetermined pitch. The dots are selectively actuated in accordance with printing data for performing printing. The printing may be performed by a heat transfer method using ink ribbon or by a more direct method using thermosensitive recording paper. The printing is performed for one line at a time. The printing speed is increased as the printing cycle for one line is shortened. Accordingly, the feeding speed of the recording paper is increased. Recently, an effort has been made to provide a thermal printhead having thus increased printing speed to meet the requirement of a higher-speed printer.

In general, heating dots of a thermal printhead tend to accumulate heat because of the presence of a glaze layer. When the printing speed is increased, such a heat-accumulating tendency of the heating dots will give rise to the following problem.

It is now assumed that each of the heating dots is simply heated equally in accordance with the printing data. In case where the printing is performed to make printing dots consecutive in the secondary printing direction (which is the direction in which the recording paper is fed relative to the head), a drive energy is repetitively given to the heating dot which has been already heated by the immediately preceding drive of the heating dot for the primary scanning (in the direction of the array of heating dots) before the temperature of the heating dot drops, resulting in the increased heat accumulation at the heating dot. As a result, even if a printing operation for the next line is not expected according to the printing data, in other words, even if the consecutive driving operations of the heating dot are completed, the so-called trailing phenomenon will occur in which printing is performed on the recording paper due to the accumulated heat.

Various methods of controlling driving of a thermal printhead have been proposed to avoid the above problem, even in performing high-speed printing.

Typical examples are disclosed in Japanese Patent Application Laid-open Nos. 61-116555 and 4-305471 for instance. According to these, the printing energy to be given to the currently selected printing dot is controlled by referring to the previous ones of the printing data for the selected heating dot and for the adjacent heating dots, or in other words by referring to the history information about whether printing was performed by these dots for the last printing line and the printing line before last, or further for more previous printing lines. With such a controlling method in general, the energy to be given to the currently selected heating dot is reduced as the number of times printing was previously performed by the selected heating dot and the adjacent heating dots, for the purpose of reducing a possibility of the above-mentioned trailing phenomenon.

However, even when the above controlling method capable of reducing the trailing phenomenon is adopted, it is still difficult to completely avoid the trailing phenomenon when printing is performed at much higher speeds. Further, the following problem will occur. Specifically, the trailing phenomenon is such an occurance that printing is erroneously performed in a non-printing region near the boundary between the printing region and the non-printing region as viewed in the secondary scanning direction. However, the following problem due to the heat accumulated in the selected heating dot will occur across the boundary from the non-printing region to the printing region.

Specifically, even if a certain printing energy is given to the selected heating dot to print the first line of a printing region that is adjacent to the last line of the previous non-printing region, the heating dot may fail to be sufficiently heated up due to the shortened printing cycle for much faster printing performance. As a result, it is possible that the printing dot supposed to be printed for the first line is not formed on the recording paper. Unless such a problem taking place at the boundary from a non-printing region to a printing region is overcome, serious inconvenience as follows will result even if the trailing phenomenon can be avoided. Specifically, in an instance where high-speed printing is performed to print a bar code in the direction perpendicular to the bars, a relatively narrow bar may not be printed at all or be reduced in width more than a predetermined value, so that the specific information the bar code is supposed to represent as a whole may be altered in its meaning.

In order to prevent such a problem taking place at the boundary from the non-printing region to the printing region, it may be possible that a relatively larger amount of energy is given to the selected heating dot for printing the first line of the printing region. However, according to such a method, it is necessary to prepare a power source capable of giving such increased printing energy to all of the arrayed heating dots. This is very disadvantageous in terms of the cost.

DISCLOSURE OF THE INVENTION

Therefore, it is an object of the present invention to provide a method, an apparatus and a drive IC chip for controlling driving of a thermal printhead. According to the present invention, even if printing speed is increased than is conventionally performed, there is no need to prepare a large power source. Further, while the occurrence of the trailing phenomenon at the boundary from the printing region to the non-printing region is more effectively avoided, it is advantageously performed to print the first line of a printing region located at the boundary from a non-printing region to the printing region.

According to a first aspect of the present invention, there is provided a method of controlling driving of a thermal printhead. The method is for controlling driving of a thermal printhead which includes a plurality of arrayed heating dots selectively driven in accordance with input printing data. With the method, setting printing energy for driving each heating dot is performed according to a predetermined number of previous ones of the printing data for said each heating dot, a predetermined number of previous ones of the printing data for an adjacent heating dot and a next one of the printing data for said each heating dot. The printing energy is made smaller when the next one of the printing data is "0" than when the next one of the printing data is "1".

According to a second aspect of the present invention, there is provided an apparatus for controlling driving of a thermal printhead. The apparatus is for controlling driving of a thermal printhead selectively driving a plurality of arrayed heating dots in accordance with input printing data. The apparatus includes controlling means for controlling setting of printing energy, in driving each heating dot, according to a predetermined number of previous ones of the printing data for said each heating dot, a predetermined number of previous ones of the printing data for an adjacent heating dot and a next one of the printing data for said each heating dot. The printing energy is made smaller when the next one of the printing data is "0" than when the next one of the printing data is "1".

According to a third aspect of the present invention, there is provided a drive IC chip for a thermal printhead. The drive IC chip is designed for a thermal printhead selectively driving a plurality of arrayed heating dots in accordance with input printing data. The IC chip includes: a plurality of register groups each including a plurality of registers to store a next one of the printing data, a current one of the printing data, a predetermined number of previous ones of the printing data, and a predetermined number of previous ones of the printing data for an adjacent heating dot; and a plurality of pattern discerning circuits for consecutively discerning a history pattern of each heating dot and outputting corresponding driving data so that printing energy for said each heating dot is made smaller when the next one of the printing data stored in the register group is "0" than when the next one of the printing data is "1".

According to a fourth aspect of the present invention, there is provided another method for controlling driving of a thermal printhead. The method is for controlling driving of a thermal printhead including a plurality of arrayed heating dots which are selectively driven in accordance with input printing data. With the method, setting printing energy for driving each heating dot is performed according to a predetermined number of previous ones of the printing data for said each heating dot, a predetermined number of previous ones of the printing data for an adjacent heating dot and a next one of the printing data for said each heating dot. Said each heating dot is to be given predetermined printing energy when the next one of the printing data is "1", even when a current one of the printing data for said each heating dot is "0" and the previous ones of the printing data for said each heating dot and the previous ones of the printing data for the adjacent heating dot are all "0".

According to a fifth aspect of the present invention, there is provided another apparatus for controlling driving of a thermal printhead. The apparatus is for controlling driving of a thermal printhead selectively driving a plurality of arrayed heating dots in accordance with input printing data. Printing energy for driving each heating dot is set according to a predetermined number of previous ones of the printing data for said each heating dot, a predetermined number of previous ones of the printing data for an adjacent heating dot and a next one of the printing data for said each heating dot. The apparatus includes controlling means for applying predetermined printing energy on said each heating dot when the next one of the printing data is "1", even when a current one of the printing data for said each heating dot is "0" and the previous ones of the printing data for said each heating dot and the previous ones of the printing data for the adjacent heating dot are all "0".

According to a sixth aspect of the present invention, there is provided another drive IC chip for a thermal printhead. The drive IC chip is designed for a thermal printhead selectively driving a plurality of arrayed heating dots in accordance with input printing data. The IC chip includes: a plurality of register groups each including a plurality of registers to store a next one of the printing data, a current one of the printing data, a predetermined number of previous ones of the printing data, and a predetermined number of previous ones of the printing data for an adjacent heating dot; and a plurality of pattern discerning circuits for consecutively discerning a history pattern of each heating dot and outputting corresponding driving data so that predetermined printing energy is applied to said each heating dot when the next one of the printing data stored in the register group is "1", even when the current one of the printing data stored in the register group is "0" and the previous ones of the printing data and the previous ones for the adjacent heating dot are all "0".

According to a seventh aspect of the present invention, there is provided another method of controlling driving of a thermal printhead. The method is for controlling driving of a thermal printhead including a plurality of arrayed heating dots which are selectively driven in accordance with input printing data. With the method, setting printing energy for driving each heating dot is performed according to a predetermined number of previous ones of the printing data for said each heating dot, a predetermined number of previous ones of the printing data for an adjacent heating dot and a next one of the printing data for said each heating dot. The printing energy for said each heating dot is made smaller when the next one of the printing data is "0" than when the next one of the printing data is "1", and a predetermined printing energy is applied to said each heating dot when the next one of the printing data is "1", even when the current one of the printing data for said each heating dot is "0" and the previous ones of the printing data for said each heating dot and the previous ones of the printing data for the adjacent heating dot are all "0".

According to an eighth aspect of the present invention, there is provided another apparatus for controlling driving of a thermal printhead. The apparatus is for controlling driving of a thermal printhead selectively driving a plurality of arrayed heating dots in accordance with input printing data. Printing energy for driving each heating dot is set according to a predetermined number of previous ones of the printing data for said each heating dot, a predetermined number of previous ones of the printing data for an adjacent heating dot and a next one of the printing data for said each heating dot. The apparatus includes controlling means for arranging that the printing energy for said each heating dot is made smaller when the next one of the printing data is "0" than when the next one of the printing data is "1", and that predetermined printing energy is applied on said each heating dot when the next one of the printing data is "1", even when a current one of the printing data for said each heating dot is "0" and the previous ones of the printing data for said each heating dot and the previous ones of the printing data for the adjacent heating dot are all "0".

According to a ninth aspect of the present invention, there is provided another drive IC chip for a thermal printhead. The drive IC chip is designed for a thermal printhead selectively driving a plurality of arrayed heating dots in accordance with input printing data. The IC chip includes: a plurality of register groups each including a plurality of registers to store a next one of the printing data, a current one of the printing data, a predetermined number of previous ones of the printing data, and a predetermined number of previous ones of the printing data for an adjacent heating dot; and a plurality of pattern discerning circuits for consecutively discerning a history pattern of each heating dot and outputting corresponding driving data so that printing energy for said each heating dot is made smaller when the next one of the printing data stored in the register group is "0" than when the next one of the printing data is "1" and so that the printing energy is applied to said each heating dot in a predetermined amount when the next one of the printing data is "1", even when the current one of the printing data stored in the register group is "0" and the previous ones of the printing data for said each heating dot and the previous ones of the printing data for the adjacent heating dot stored in the register group are all "0".

According to a preferred embodiment, for setting the printing energy with respect to said heating dot according to a history pattern, the printing data used in discerning the history pattern may be variable in number in accordance with a controlling signal.

According to another preferred embodiment, the printing energy applied to said each heating dot may be variable within a range including zero in accordance with a controlling signal when the current one of the printing data for said each heating dot is "0", the previous ones of the printing data for said each heating dot and the previous ones of the printing data for the adjacent heating dot are all "0", and the next one of the printing data is "1".

In the above, that the printing data is "1" means that the heating dot is actuated, whereas that the printing data is "0" means that the heating dot is not actuated.

Various features and advantages of the present invention will become clearer from the embodiments described below with reference to the accompanying drawings.

BRIEF DESCRIPTION OF THE DRAWINGS

FIG. 2 is a table for explaining a method according to the present invention;

FIG. 9 is a table illustrating the relation between history patterns and energy levels for four-step controlling; and FIG. 10 is a table illustrating the relation between history patterns and energy levels for three-step controlling.

BEST MODE FOR CARRYING OUT THE INVENTION

Embodiments of the present invention will be described below with reference to FIGS. 1–10.

Figure 1:
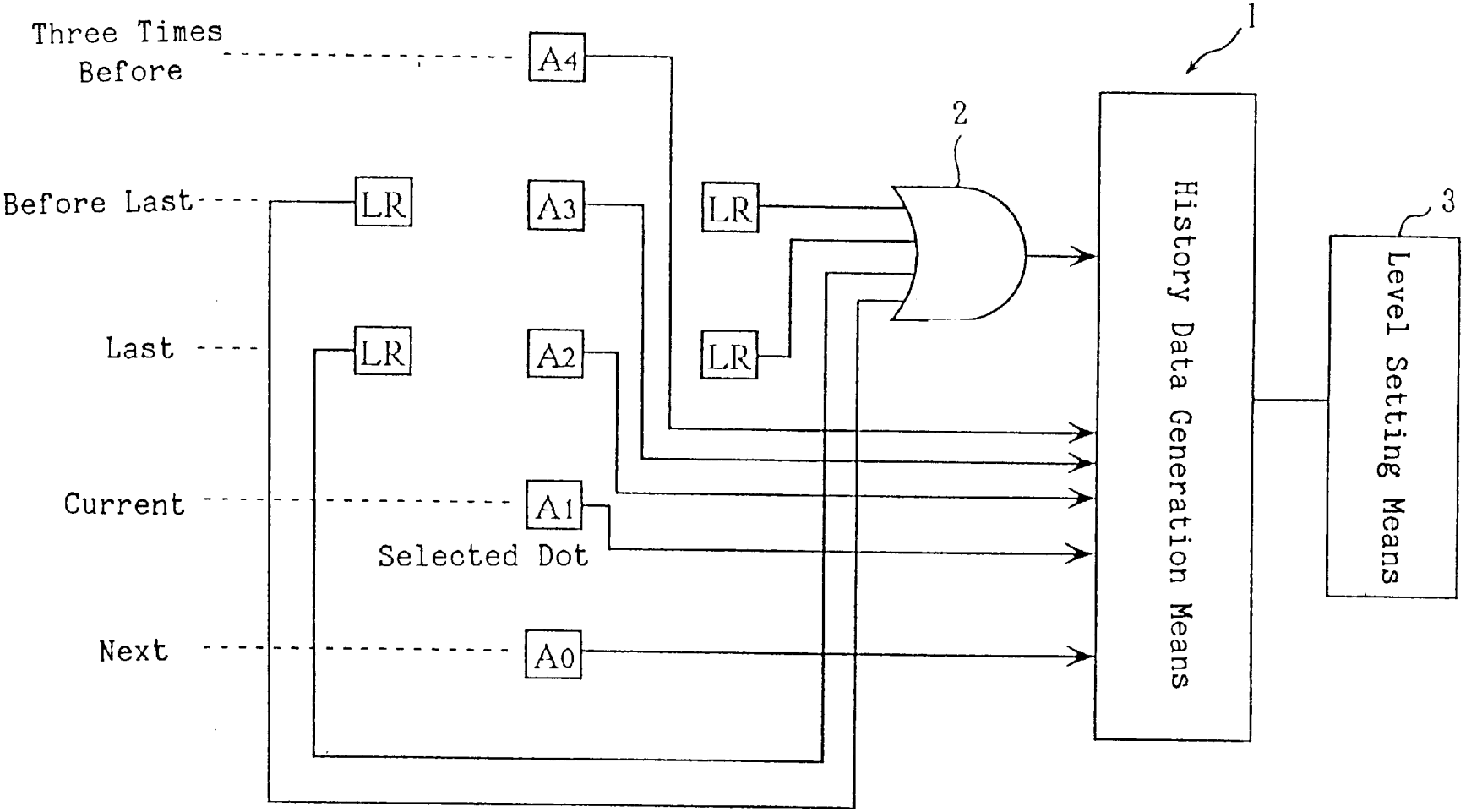
FIG. 1 is a diagram showing an example of circuit for carrying out the present invention.

FIG. 1 illustrates a circuit for sampling data to determine an energy level to be applied to a selected heating dot. In the same figure, reference A1 represents a memory cell to store a current one of printing data for the selected heating dot, reference A2 represents a memory cell to store the last one of the printing data for the selected heating dot, reference A3 represents a memory cell to store the one two times before of the printing data for the selected heating dot, and reference A4 represents a memory cell to store the one three times before of the printing data for the selected heating dot. Reference LRs represent memory cells to store the last ones and the ones two times before of the printing data for the adjacent heating dots. Reference A0 represents a memory cell to store the next one of the printing data for the selected heating dot.

Data from the respective cells A0, A1, A2, A3, A4 for the selected heating dot are separately input to a history data generation means 1. With respect to the adjacent heating dots, two memory cells LR are provided on each of the opposite sides of the selected heating dot, that is, four cells in total. However, in the present invention, data from these cells are logically added via an OR circuit 2 and then input to the history data generation means 1. This serves to simplify the generation and processing of the history data since it is possible to unify the printing data of the four memory cells LR when at least one of them has printing operation history, considering that the heat reservoir of the selected heating dot is less influenced by the printing history of the adjacent heating dots than by the printing history of the selected heating dot. Therefore, in the illustrated embodiment, the history data including the next one of the printing date for the selected heating dot are produced in a form of six-bit data such as (A0, A1, A2, A3, A4, LR).

FIG. 1 shows the arrangement of the memory cells with respect to the single selected heating dot for convenience. However, memory cells arranged like those shown in FIG. 1 are used for the respective heating dots linearly disposed on the thermal printhead. The respective memory cells are provided by utilizing predetermined memory elements of five shift registers which are mutually connected and store consecutively the one to three times before of the printing data through the next one of the printing data by the line. The printing data in the respective shift registers are rotated simultaneously in the same direction in synchronism with clock pulses. Thus, with respect to substantially any one of the heating dots, it is possible to provide the cell arrangement relative to the memory cell for the current one of the printing data for the heating dot, as shown in FIG. 1.

According to the present invention, based on the six-bit history data (A0, A1, A2, A3, A4, LR), the level setting means 3 sets an energy level to be applied to the selected heating dot in a predetermined manner.

FIG. 2 shows an example as to how the energy level should be determined. The history patterns (1)–(32) show instances in which the current one of the printing data (A1) for the selected heating dot is "1". Of these, the printing patterns (1)–(16) show instances in which the next one of the printing data (A0) for the selected heating dot is "1", whereas the printing patterns (17)–(32) show instances in which the next one of the printing data (A0) for the selected heating dot is "0". The history pattern (33) shows an instance in which only the next one of the printing data (A0) for the selected heating dot is "1", while the printing data for the other memory cells are all "0". The energy level becomes smaller as the number increases.

According to the first aspect of the present invention, the printing energy for the selected heating dot is made smaller when the next one of the printing data (A0) is "0" than when the next one of the printing data is "1". For instance, referring to FIG. 2, the energy level for the history pattern (6) (1,1,1,0,0,0) is 3, whereas the energy level for the history pattern (28) (0,1,1,0,0,0) is reduced to 5. The energy level for the history pattern (9) (1,1,1,1,0,0) is 4, whereas the energy level for the history pattern (29) (0,1,1,1,0,0) is reduced to 6. The energy level for the history pattern (10)

(1,1,1,0,0,1) is 4, whereas the energy level for the history pattern (27) (0,1,1,0,0,1) is reduced to 5. The energy level for the history pattern (13) (1,1,1,1,1,0) is 4, whereas the energy level for the history pattern (31) (0,1,1,1,1,0) is reduced to 6. The energy level for the history pattern (14) (1,1,1,1,1,1) is 5, whereas the energy level for the history pattern (32) (0,1,1,1,1,1) is reduced to 6. The energy level for the history pattern (16) (1,1,1,1,0,1) is 5, whereas the energy level for the history pattern (30) (0,1,1,1,0,1) is reduced to 6.

In other words, the fact that the next one of the printing data is "0" means that the current printing by the selected heating dot is a printing operation at the last line for a print region. In such an instance, the printing energy is made smaller compared with an instance where printing is not performed at the last line for the print region. As a result, a trailing phenomenon which might otherwise occur due to the heat remaining in the selected heating dot is effectively avoided, and the finish edge of the print region is more sharply printed.

According to a fourth aspect of the present invention, predetermined printing energy is applied to the selected heating dot when the next one of the printing data is "1", even if the current one of the printing data for the selected heating dot is "0", and the previous ones of the printing data for the selected heating dot and the previous ones of the printing data for the adjacent heating dots are all "0". Referring to FIG. 2, the history pattern (33) (1,0,0,0,0,0) shows an example of the controlling according to the fourth aspect of the present invention. For this instance, the energy level in the embodiment is set to be 6.

In the above case, it should be noted that some energy is applied to the selected heating dot even when the current one of the printing data for the selected heating dot is "0". Therefore, it is necessary to generate a dummy printing data for example, so that the current one of the printing data for the selected heating dot is modified in the printing data set in the driver.

The above history pattern (1,0,0,0,0,0) indicates that the selected heating dot corresponds to the last line of a non-print region, that is, to one line before the first line of a print region. In such an instance, according to the present invention, predetermined energy is applied to the selected heating dot for preheating thereof. More specifically, in this instance, the history pattern in the next printing cycle will be (1) (1,1,0,0,0,0), and the maximum energy corresponding to energy level 1 will be applied to the selected heating dot. Since the selected heating dot is preheated as mentioned above, the temperature of the selected heating dot is sufficiently increased for printing the first line of the next print region, even for performing a high-speed printing operation. As a result, the start edge of the print region is sharply printed.

Further, according to the combination of the first and the fourth aspects of the present invention, the start edge and the finish edge of the print region are both sharply printed. Thus, a high-speed printing operation for a bar cord for example is advantageously performed in the direction perpendicular to the bars.

Figure 3:
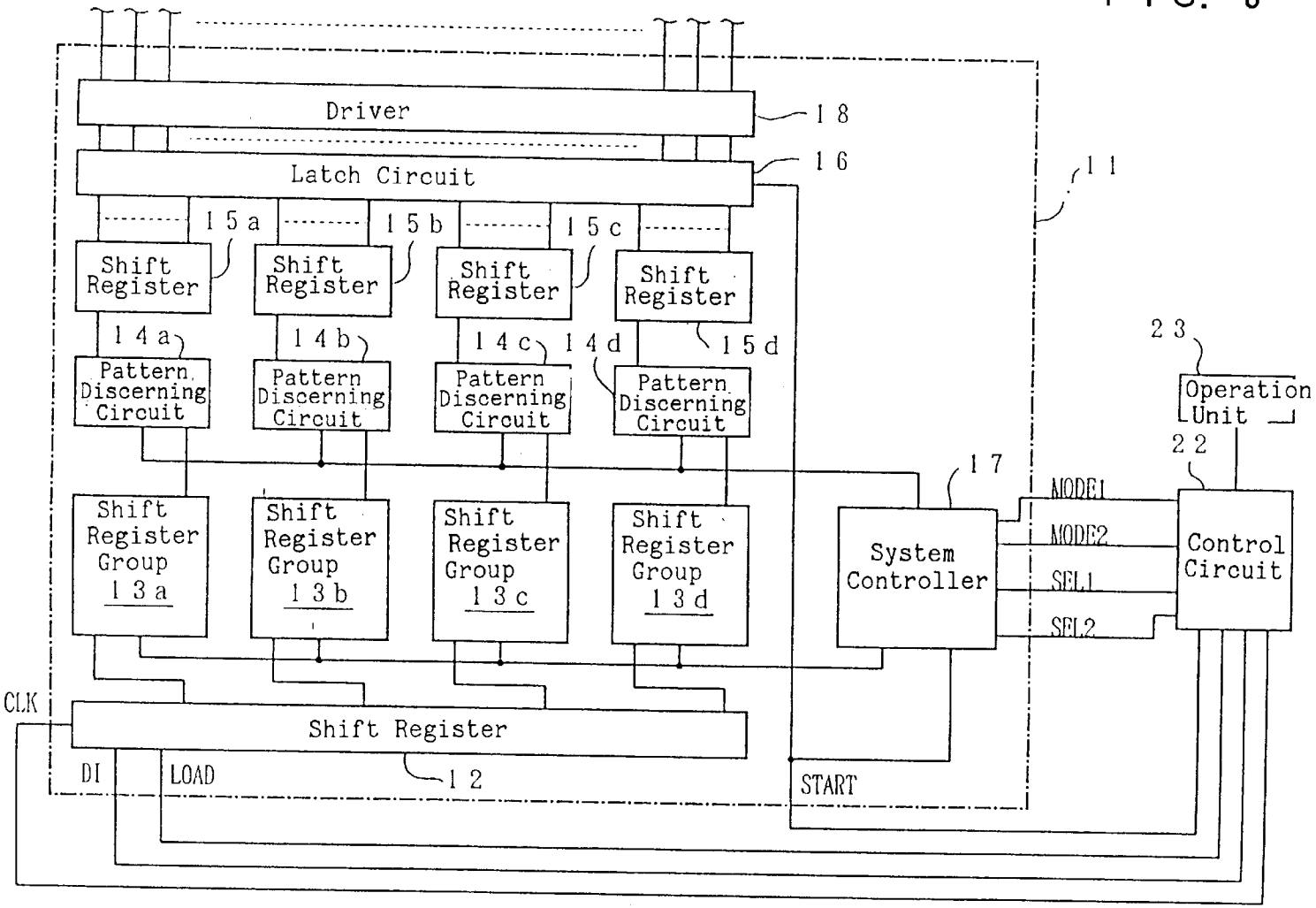
FIG. 3 is a circuit block diagram of a drive IC chip for constituting an apparatus according to the present invention.

FIG. 3 is a circuit block diagram of a drive IC chip constituting a drive control apparatus for carrying out the above method of controlling driving of a thermal printhead. The drive control apparatus is realized by using ten drive IC chips for example. The drive IC chip 11 includes an input shift register 12, four shift register groups 13*a*–13*d*, four pattern discerning circuits 14*a*–14*d*, four shift registers 15*a*–15*d*, a latch circuit 16, a system controller 17 and a driver 18.

The input shift register 12 receives 128-bit printing data DI load signals LOAD and clock signals CLK, for example, from a control circuit 22 of the printer and stores the printing data DI. Each of the shift register groups 13*a*–13*d* includes five shift registers which store, respectively, the next one of the printing data, the current one of the printing data, the last one of the printing data, the one before the last of the printing data and the one further before the last of the printing data. These stored printing data are processed by the pattern discerning circuits 14*a*–14*d*. The pattern discerning circuits 14*a*–14*d* are constructed from logic circuits and embody the history data generation means 1, the OR circuit 2 and the level setting means 3. The shift registers 15*a*–15*d* store the driving data from the pattern discerning circuits 14*a*–14*d*. The latch circuit 16 latches the driving data from the shift registers 15*a*–15*d* in accordance with the timing of the start signals START from the control circuit 22, and outputs 128-bit driving data as drive control signals. The system controller 17 receives the start signals START, history control mode select signals MODE1, MODE2 and preheat level select signals SEL1, SEL2 from the control circuit 22, and controls the shift register groups 13*a*–13*d* and the pattern discerning circuits 14*a*–14*d*. The driver 18 is constructed from many MOS-FETs and controls the electric passage to the respective heating dots in accordance with the driving signals from the latch circuit 16.

Next, the operations will be described. It is assumed that the contents of the registers and the others are all cleared in an initial state after the power is turned on. When the load signals LOAD applied to the input shift register 12 from the control circuit 22 become active, 128-bit printing data DI are serially and consecutively input to the input shift register 12 from the control circuit 22 in synchronism with the timing of the clock signals CLK, and are stored in 128-bit memory cells. One bit of the 128-bit printing data corresponds to one picture element or heating dot. One drive IC chip 11 performs the controlling of 128 heating dots, and thus ten drive IC chips 11 control 1280 heating dots. The 1280 heating dots simultaneously perform printing for one line.

The respective 128-bit printing data stored in the input shift register 12 are serially transferred to the first shift registers of the shift register groups 13*a*–13*d* and stored therein. At this stage, the current printing data are stored in the shift register groups 13*a*–13*d*, while the next printing data are not yet stored in the shift register groups 13*a*–13*d*. Thus, the processing by the pattern discerning circuits 14*a*–14*d* is not started, and the printing operation is not performed. Then, according to similar operations described above, the next printing data are stored in the input shift register 12 and transferred to the shift register groups 13*a*–13*d*. At this stage, the processing by the pattern discerning circuits 14*a*–14*d* starts, and the printing operation is performed. In this instance, it is obvious that the last and further before ones of the printing data are all "0".

Figure 4:
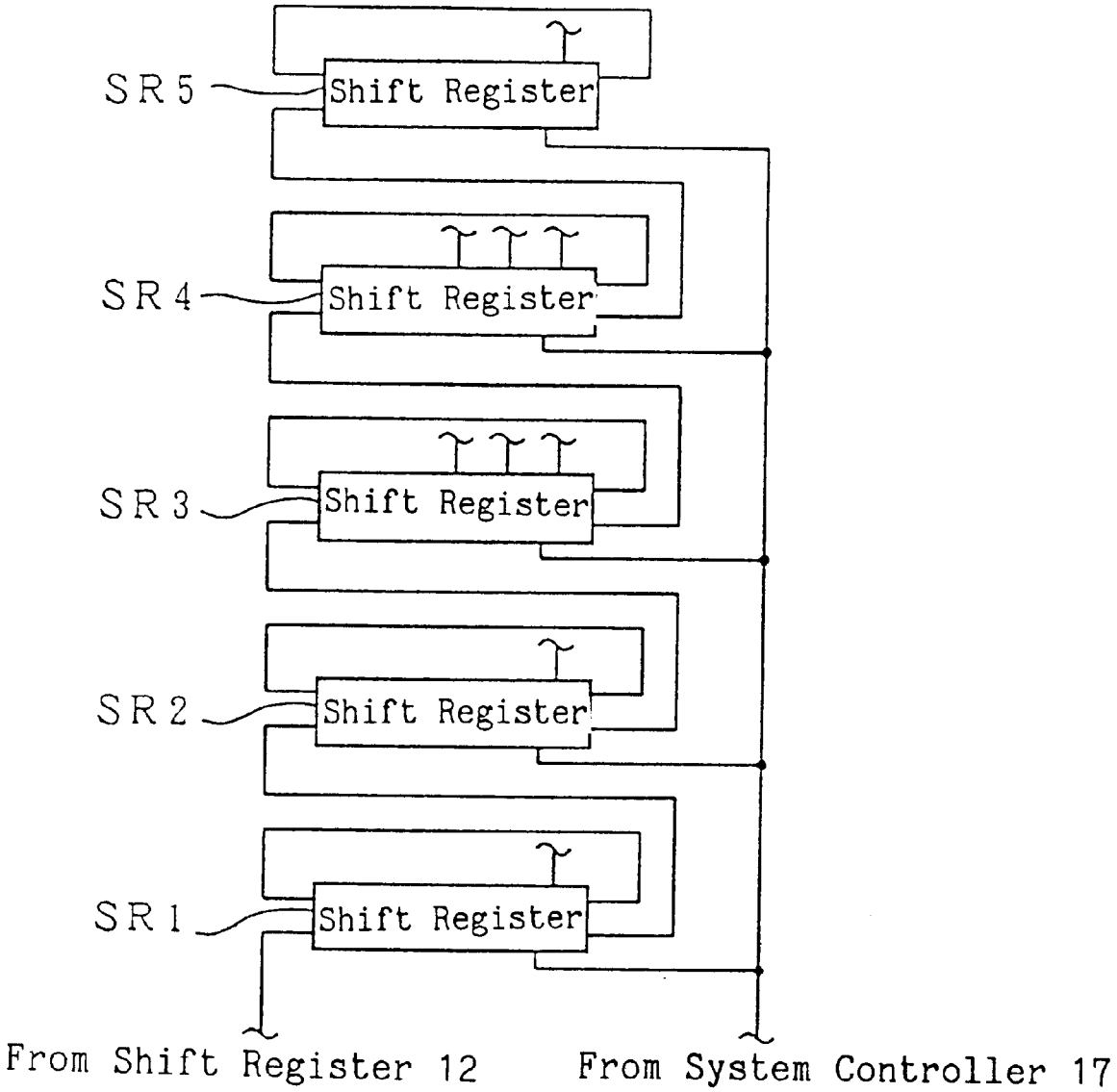
FIG. 4 is a circuit block diagram illustrating a shift register group.

Next, the shift register groups 13*a*–13*d* will be described in detail. As shown in FIG. 4, each of the shift register groups 13*a*–13*d* includes five shift registers SR1–SR5. A mode in which the printing data in each of the shift registers SR1–SR5 are consecutively shifted in a circle and a mode in which the printing data are consecutively transferred to the next shift registers SR2–SR5 are changed to each other in accordance with the control signals from the system controller 17. Each of the shift registers SR1–SR5 is of 34-bit type. The shift register SR1 stores the next one of the printing data, the shift register SR2 stores the current one of the printing data, the shift register SR3 stores the first previous one of the printing data, the shift register SR4 stores the second previous one of the printing data, and the shift register SR5 stores the third previous one of the printing data. The processing by the pattern discerning circuits 14*a*–14*d* is performed for every 32-bit. As is seen from FIG. 1, the last one of the printing data and the one before last of the printing data are needed not only for the selected heating dot but for the adjacent heating dots. Thus, each of the shift register groups 13*a*–13*d* stores the 34-bit printing data resulting from the 32-bit data plus 2-bit data.

After each of the shift register groups 13*a*–13*d* has stored up to the next one of the printing data, the pattern discerning circuits 14*a*–14*d* discern the history patterns shown in FIG. 2 by referring to the printing data stored in the shift registers SR1–SR5 of the respective shift register groups 13*a*–13*d*, and set energy levels corresponding to the patterns for every bit. The resulting driving data are consecutively output to shift registers 15*a*–15*d*. In this way, the pattern discerning circuits 14*a*–14*d* embody the history data generation means 1, the OR circuit 2 and the level setting means 3 shown in FIG. 1.

Figure 5:
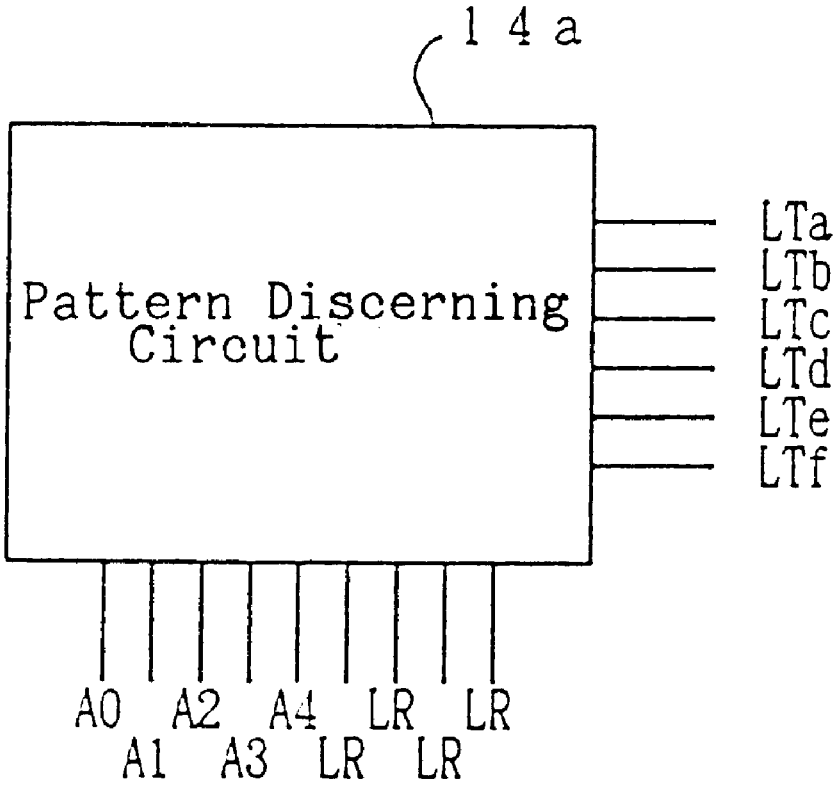
FIG. 5 is a diagram illustrating input signals for a pattern discerning circuit.
Figure 6:
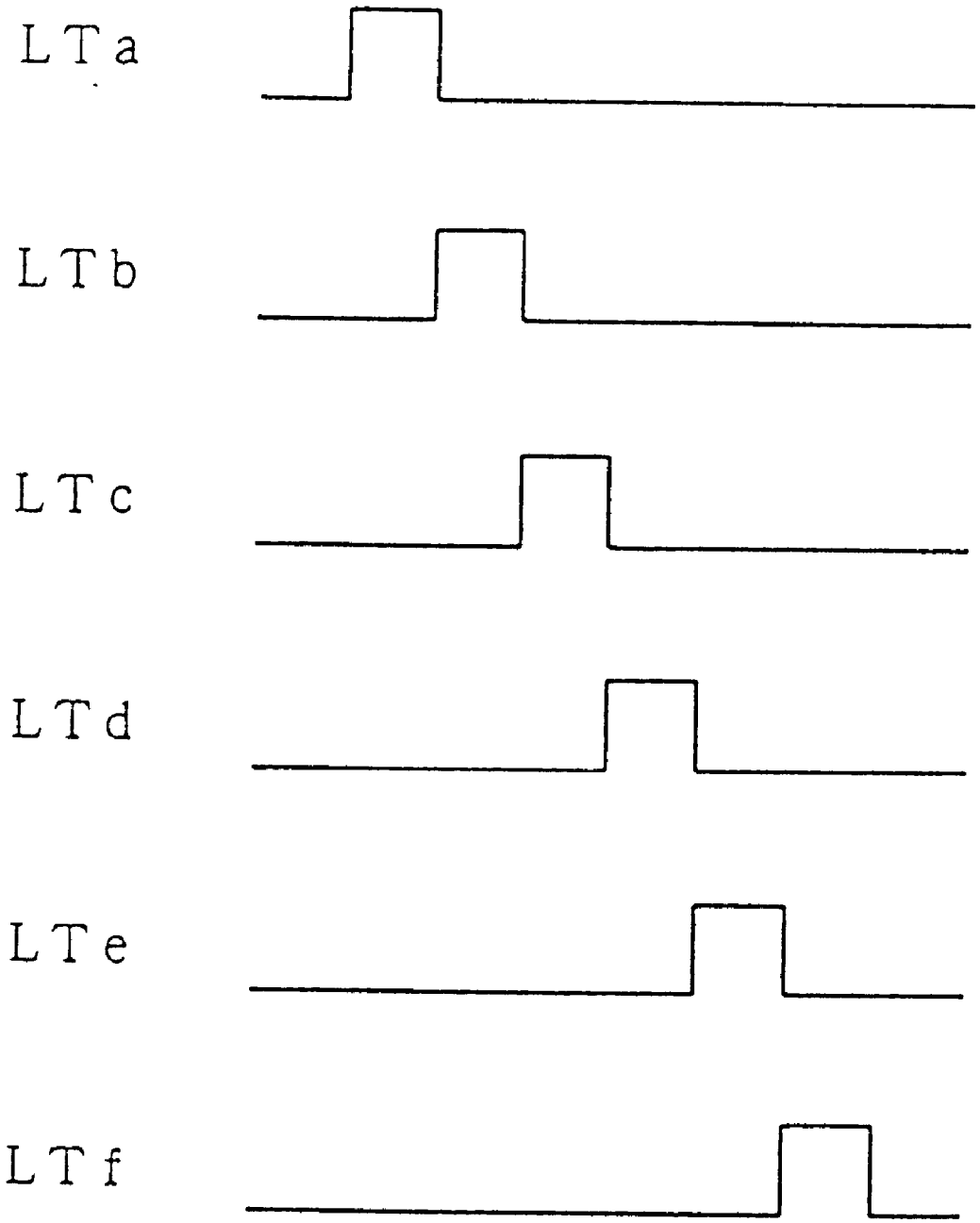
FIG. 6 is a diagram illustrating level timing signals supplied to the pattern discerning circuit.

The operations of the pattern discerning circuits 14*a*–14*d* will be described. FIG. 5 illustrates input signals for the pattern discerning circuit 14*a*. The pattern discerning circuit 14a receives nine printing data A0, A1, A2, A3, A4, LR, LR, LR, LR as shown in FIG. 1 from particular bits of the shift registers SR1–SR5 of the shift register group 13*a*, while receiving six level timing signals LTa–LTf from the system controller 17. As shown in FIG. 6, the level timing signals LTa–LTf have consecutively offset activation timings. Each time the level timing signals LTa–LTf are input, the pattern discerning circuits 14*a*–14*d* discern the pattern of the printing data A0, A1, A2, A3, A4, LR, LR, LR, LR from the shift register groups 13*a*–13*d* and output 1 bit of the driving data to the shift registers 15*a*–15*d*. Such processing is repeated thirty two times to process 32 bits. At this time, every time the processing for 1 bit is completed, the printing data in the respective shift registers SR1–SR5 of the shift register groups 13*a*–13*d* are shifted by one bit in a circle in accordance with the control signals from the system controller 17. Thus, printing data A0, A1, A2, A3, A4, LR, LR, LR, LR corresponding to another selected heating dot are input to the pattern discerning circuits 14*a*–14*d*. In this way, while six level timing signals LTa–LTf are being input, each of the pattern discerning circuits 14*a*–14*d* outputs 32-bit driving data six times. Thus, the heating dots perform printing operations up to six times.

Next, the driving data will be described in detail. While any one of the six level timing signals LTa–LTf is being input, 32-bit driving data are output from the respective pattern discerning circuits 14*a*–14*d*, and applied to the shift registers 15*a*–15*d*. When a bit of the printing data is "1", an electric current is passed across the heating dot corresponding to the bit to perform printing. The driving data are output six times for one line printing, so that the printing energy can be made adjustable to six levels. More specifically, when a heating dot has a history pattern of FIG. 2 that corresponds to level 1, the bit of the corresponding driving data becomes "1" six times, and the drive control signal is applied six times. Thus, the total period for applying an electric current to the heating dot is increased, so that the maximum energy level is attained. Further, when a heating dot has a history pattern of FIG. 2 that corresponds to level 6, the bit of the corresponding driving data becomes "1" only once, and the drive control signal is applied once. Thus, the total period for applying an electric current to the heating dot is shortened, so that the minimum energy level is attained. For instance, when the printing data A0, A1, A2, A3, A4, LR for a particular bit to be processed by the pattern discerning circuit 14*a* is (1,1,0,0,0,0), the data corresponds to the history pattern (1) of FIG. 2, and thus the energy level is 1. Therefore, for this bit, the driving data becomes "1" six times in total in correspondence with the level timing signals LTa–LTf.

Figure 7:
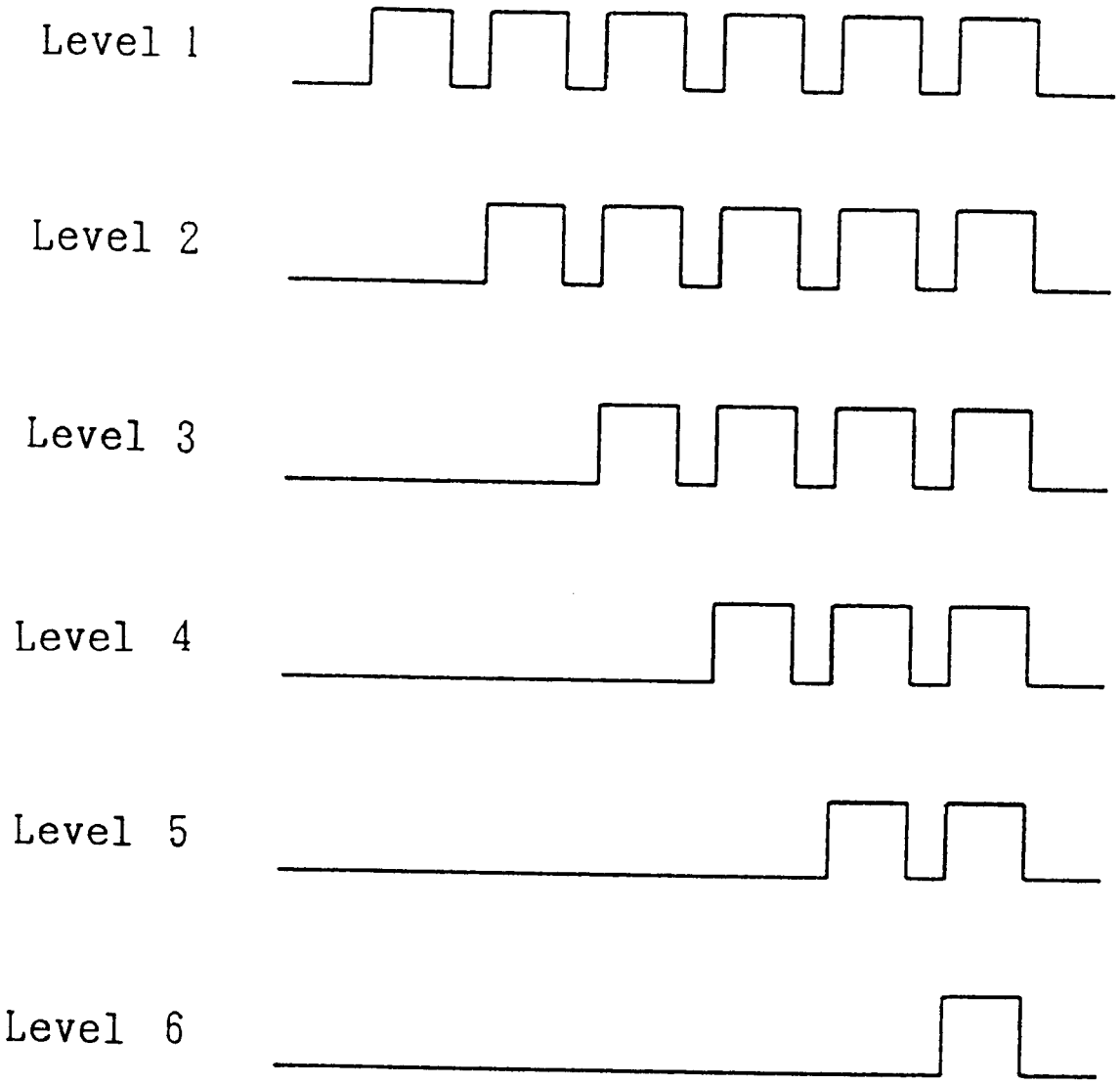
FIG. 7 is a diagram illustrating the relations between printing energy levels at the heating dots and driving data.

Alternatively, when the printing data A0, A1, A2, A3, A4, LR is (0,1,1,1,1,1), the data corresponds to the history pattern (32) of FIG. 2, and thus the energy level is 6. Therefore, for this bit, the driving data becomes "1" only once at the time of inputting the level timing signal LTf. In this way, each bit of the driving data is activated predetermined times in accordance with the printing energy level, as shown in FIG. 7.

In short, the logic circuits constituting the pattern discerning circuits 14*a*–14*d* are arranged in such a manner that the printing data A0, A1, A2, A3, A4, LR,LR,LR,LR and the level timing signals LTa–LTf are calculated via many logic gates, and that the driving data are caused to be "1" predetermined times in accordance with the energy level corresponding to a history pattern of each heating dot as shown in FIG. 2.

Figure 8:
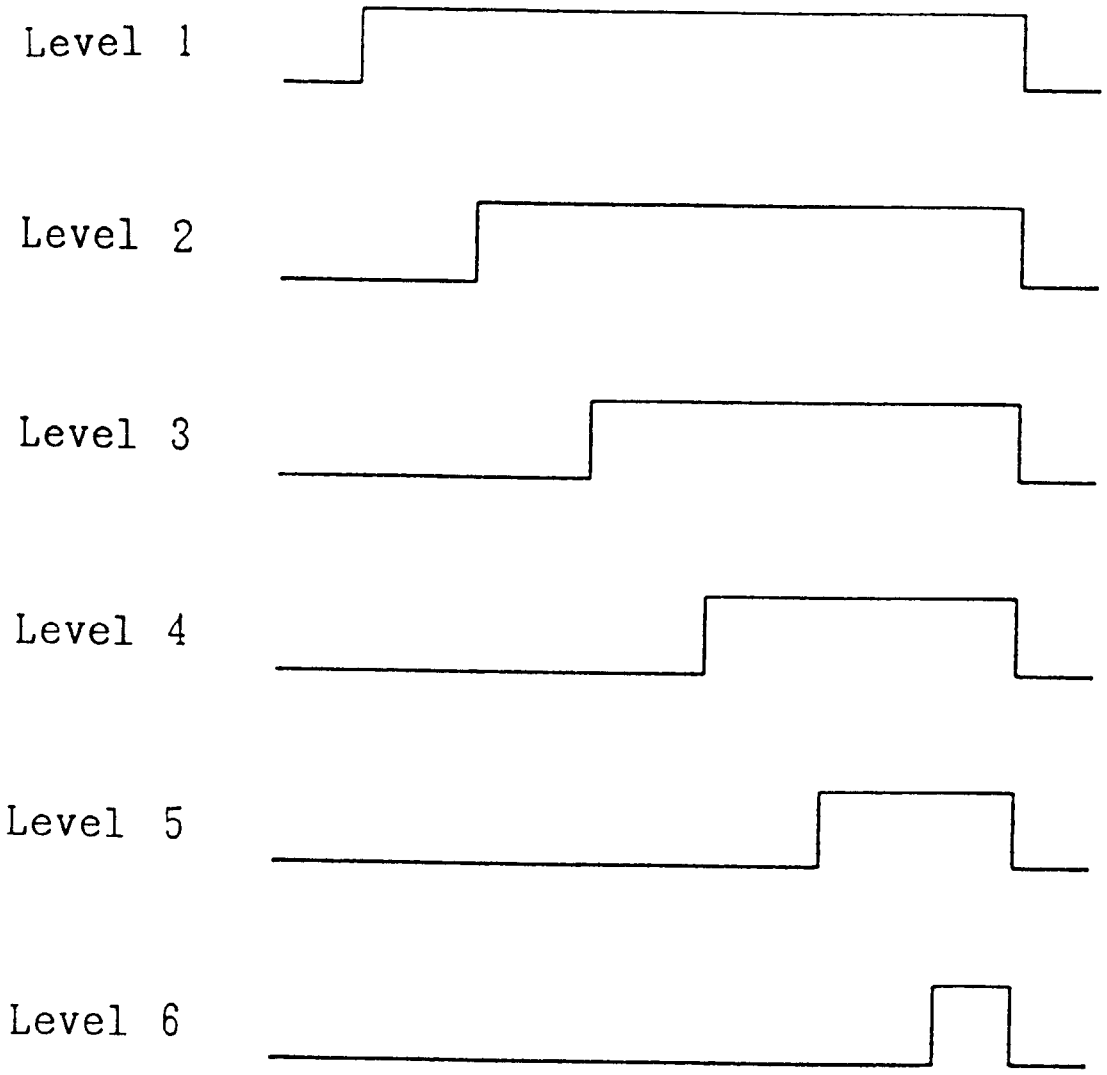
FIG. 8 is a diagram illustrating the relations between printing energy levels at the heating dots and the driving signals actually applied to the heating dots.

The driving data are serially output from the pattern discerning circuits 14*a*–14*d*, and then consecutively stored in the shift registers 15*a*–15*d*. After 32-bit driving data are stored in each of the shift registers 15*a*–15*d*, the data are simultaneously transferred to the latch circuit 16 and latched in the latch circuit 16. The 128-bit driving data latched in the latch circuit 16 are output as driving signals to the driver 18 at the timing of the start signal START from the control circuit 22. As shown in FIG. 8, an on-period for each bit of the driving signals is determined in accordance with the printing energy level, or specifically, with the number of times the driving data get activated. In accordance with the driving signals, the driver 18 controls the driving of the heating dots of the thermal printhead, thereby performing printing in accordance with the driving signals. More specifically, the drivers 18 of the respective ten drive IC chips 11 output 1280-bit driving signals in total, and the 1280 heating dots simultaneously perform printing for one line. As previously described, this operation is performed by repeating the outputting of the driving data for one line printing six times. After printing the line, the printhead is moved relative to the recording paper in the secondary scanning direction by a predetermined distance, and the above described operations are performed for the next line.

It should be noted that such a history controlling method can be modified by the signals from the control circuit 22. Specifically, the user operates the operation unit 23 of the printer to alter the contents of the history control mode select signals MODE1, MODE2 supplied to the system controller 17 from the control circuit 22. As a result, the above mentioned five-step control is changed to four-step control or three-step control. The five-step control is a controlling method in which the printing energy level is determined by the five printing data A0, A1, A2, A3, A4 plus the printing data LR from the adjacent heating dots as shown in FIG. 1. The four-step control is a controlling method in which the printing energy level is determined by the four printing data A1, A2, A3, A4 (the next one of the printing data A0 is excluded) plus the printing data LR from the adjacent heating dots. The three-step control is a controlling method in which the printing energy level is determined by the three printing data A1, A2, A3 (the next one of the printing data A0 and the three times previous one of the printing data A4 are excluded) plus the printing data LR from the adjacent heating dots. More specifically, with the four-step control, control signals for four-step control are applied to the pattern discerning circuits 14*a*–14*d* from the system controller 17, so that the printing data A0 is rendered to be constantly "1" in spite of the actual printing data. The resulting relation between the history patterns and the energy levels is shown in FIG. 9. With the three-step control, control signals for three-step control are applied to the pattern discerning circuits 14*a*–14*d* from the system controller 17, so that the printing data A0 is rendered to be constantly "1" in spite of the actual printing data while the printing data A4 is rendered to be constantly "0" in spite of the actual printing data. The resulting relation between the history patterns and the energy levels is shown in FIG. 10.

Further, the energy levels for preheating are also variable. Specifically, for an instance where preheating is performed in accordance with the history pattern (33) of FIG. 2, the printing energy level of the figure is set at the minimum value of 6. However, when the user operates the control unit 23 of the printer, the contents of the preheat level select signals SEL1, SEL2 are changed. As a result, the preheat energy level may be selectively changed to level 4, 5, 6 or non-preheat level. More specifically, the system controller 17 and the pattern discerning circuits 14*a*–14*d* are connected via three signal lines for preheat control. When one of the preheat energy levels 4, 5, 6 is selected, the signal via corresponding one of the three signal lines becomes active. On the other hand, when the non-preheat level is selected, no signals of the three signal lines become active. The logic circuits constituting the pattern discerning circuits 14*a*–14*d* are designed so that the preheat energy levels are changed in accordance with the signals via the three signal lines. Obviously, the change of the energy levels can be realized by altering the number of times the driving signals become "1" as described above.

The above drive control apparatus incorporating the drive IC chips 11 for a thermal printhead is designed to function in accordance with the above method of controlling driving of a thermal printhead. Therefore, even when the printing speed is increased more than is conventionally performed, both of the start edge and the final edge of a print region are sharply printed. Thus, it is remarkably advantageous to use the above apparatus for performing high-speed printing of a bar code for example in the direction perpendicular to the bars.

Further, the shift register groups 13*a*–13*d*, the pattern discerning circuits 14*a*–14*d* and the like provided for processing the history controlling are incorporated as a whole within the drive IC chip 11. Thus, there is no need to prepare other IC chips specially designed for the history controlling besides the above drive IC chips. As a result, it is possible to produce print heads which are small in size and weight, while the production costs can be reduced.

Further, the controlling mode of the history controlling is changed by operating the operation unit 23. For instance, the five-step control may be used for superhigh-speed printing, the four-step control for high-speed printing, and the three-step control for low-speed printing. Thus, the user can select among the modes of the history control.

Further, the preheat energy can be set at different levels including 0 level by operating the operation unit 23. Thus, it is possible for the user to select a proper preheating level in accordance with the temperature of the atmosphere at the time of printing or the kinds of recording paper or ink.

Further, a plurality of register groups and pattern discerning circuits are provided, so that the printing data are divided into blocks and processed in parallel. In this way, small drive IC chips are produced, while high-speed processing is realized. More specifically, four pattern discerning circuits 14*a*–14*d* are provided and each of them is arranged to discern 32-bits of the history patterns. Therefore, the circuit is much more easily constructed compared to an instance where a pattern discerning circuit is provided for each bit. Further, the drive IC chip 11 can be produced to be small in size and weight, while the production cost is reduced. Still further, unlike an instance where 128-bit processing is performed by a single pattern discerning circuit, it is possible to avoid an inconvenience such as a failure of superhigh-speed printing due to low processing speed.

Obviously, the scope of the present invention is not limited to the above embodiments. It may be suitably determined how many previous ones of the printing data should be referred to. Further, in the above embodiments, the logic state of the previous ones of the printing data for the adjacent beating dots is calculated to provide simplified history data as well as simplified processing operations and circuit arrangement. However, it is also possible to individually refer to the previous ones of the printing data for the adjacent heating dots as in a case of the selected heating dot. Six printing cycles which correspond to the driving data provided six times in total for printing one line may be equalized in length. Alternatively, the length of the cycles may differ in any ways. For instance, the sixth cycle may be the longest. The actual printing energy can be set at a desired value corresponding to the printing energy levels by relatively weighting the six driving data.

INDUSTRIAL APPLICABILITY

A method, an apparatus and a drive IC chip for controlling driving of a thermal printhead according to the present invention are useable to a printer performing printing by heat, and the like.

We claim:

1. A drive control apparatus for a thermal printhead provided with a plurality of heating dots which are selectively driven in accordance with printing data, the drive control apparatus including:

a printing energy controlling means for setting printing energy for each heating dot based on a history pattern which includes pieces of printing data for said each heating dot and pieces of printing data for an adjacent heating dot, said pieces of printing data for said each heating dot including previous pieces, a current piece and a next piece of printing data for said each heating dot, the printing energy for said each heating dot being made smaller when the next piece of printing data is "0" than when the next piece of printing data is "1"; and a mode controlling means for selecting part of the previous pieces of printing data for said each heating dot.

2. The drive control apparatus according to claim 1, wherein the printing energy controlling means is arranged to apply a predetermined amount of printing energy to said each heating dot when the next piece of printing data is "1", even when the current and previous pieces of printing data for said each heating dot are "0" and said pieces of printing data for the adjacent heating dot are "0".

3. The drive control apparatus according to claim 2, wherein the applied predetermined amount of printing energy is variable within a range including zero.

4. A drive IC chip for a thermal printhead selectively driving a plurality of heating dots in accordance with printing data, the IC chip comprising:

a plurality of register groups each including a plurality of registers to store a history pattern which includes pieces of printing data for each heating dot and pieces of printing data for an adjacent heating dot, said pieces of printing data for said each heating dot including previous pieces, a current piece and a next piece of printing data for said each heating dot;

a plurality of pattern discerning circuits for discerning the history pattern of each heating dot and for outputting corresponding driving data so that printing energy for said each heating dot is made smaller when the next piece of printing data is "0" than when the next piece of printing data is "1"; and a mode controller for selecting part of the previous pieces of printing data for said each heating dot.

5. The drive IC chip according to claim 4, wherein the pattern discerning circuit is arranged to apply a predetermined amount of printing energy to said each heating dot when the next piece of printing data is "1", even when the current and previous pieces of printing data for said each heating dot are "0" and said pieces of printing data for the adjacent heating dot are "0".

6. The drive IC chip according to claim 5, wherein the applied predetermined amount of printing energy is variable within a range including zero.

* * * * *